US005833554A

United States Patent [19]

Sullivan et al.

[11] Patent Number: 5,833,554

[45] Date of Patent: Nov. 10, 1998

[54] GOLF BALL

[75] Inventors: Michael J. Sullivan, Chicopee; Dennis Nesbitt, Westfield; Mark Binette, Ludlow, all of Mass.

[73] Assignee: Lisco, Inc., Tampa, Fla.

[21] Appl. No.: 887,053

[22] Filed: Jul. 2, 1997

Related U.S. Application Data

[60] Continuation-in-part of Ser. No. 530,851, Sep. 20, 1995, Pat. No. 5,766,098, which is a division of Ser. No. 171,956, Dec. 22, 1993, Pat. No. 5,503,397, which is a continuation of Ser. No. 800,198, Nov. 27, 1991, Pat. No. 5,273,287.

[51] Int. Cl.[6] ..... A63B 37/06; A63B 37/12; A63B 37/14

[52] U.S. Cl. ..... 473/374; 473/377; 473/384

[58] Field of Search ..... 473/373, 374, 473/375, 376, 377, 378, 385

[56] References Cited

U.S. PATENT DOCUMENTS 3,819,768 6/1974 Molitor .
4,201,384 5/1980 Barber .
4,919,434 4/1990 Saito ..... 473/376 X
5,674,137 10/1997 Maruko et al. ..... 473/378 X

FOREIGN PATENT DOCUMENTS 192618 2/1980 New Zealand .

*Primary Examiner*—George J. Marlo
*Attorney, Agent, or Firm*—Donald R. Bahr; Laubscher & Laubscher

[57] ABSTRACT

A golf ball having an outside diameter of substantially 1.70 to 1.80 inches and a weight no grater than 1.62 ounces.

The ball includes a spherical core, a mantel surrounding the core; and an outer cover surrounding the core and the mantle.

The mantle and outer cover each have a different Shore D hardness. The ball has a dimple pattern covering at least 70% of the surface of the ball.

5 Claims, 3 Drawing Sheets

GOLF BALL

This application is a continuation-in-part of U.S. patent Application Ser. No. 08/530,851, filed Sep. 20, 1995, now U.S. Pat. No. 5,766,098, which is a Division of U.S. patent application Ser. No. 08/171,956 filed Dec. 22, 1993, now U.S. Pat. No. 5,503,397 which is a continuation of U.S. patent application Ser. No. 800,198 filed Nov. 27, 1991, now U.S. Pat. No. 5,273,287.

This invention relates to golf balls. In particular, it relates to a three-piece golf ball having playability characteristics which are improved relative to state-of-the-art balls.

According to United States Golf Association (U.S.G.A.) rules, a golf ball may not have a weight in excess of 1.620 ounces or a diameter smaller than 1.680 inches. The initial velocity of U.S.G.A. "regulation" balls may not exceed 250 feet per second with a maximum tolerance of 2%. Initial velocity is measured on a standard machine kept by the U.S.G.A. A projection on a wheel rotating at a defined speed hits the test ball, and the length of time it takes the ball to traverse a set distance after impact is measured. U.S.G.A. regulations also require that a ball not travel a distance greater than 280 yards when hit by the U.S.G.A. outdoor driving machine under specified conditions. In addition to this specification, there is a tolerance of plus 4% and a 2% tolerance for test error.

These specifications limit how far a golf ball will travel when hit in several ways. Increasing the weight of a golf ball tends to increase the distance it will travel and lower the trajectory. A ball having greater momentum is better able to overcome drag. Reducing the diameter of the ball also has the effect of increasing the distance it will travel when hit. This is believed to occur primarily because a smaller ball has a smaller projected area and, thus, a lower drag when travelling through the air. Increasing initial velocity increases the distance the ball will travel.

The foregoing generalizations hold when the effect of size, weight, or initial velocity is measured in isolation. Flight characteristics (influenced by dimple pattern and ball rotation properties), club head speed, radius of gyration, and diverse other factors also influence the distance a ball will travel.

In the manufacture of top-grade golf balls for use by professional golfers and amateur golf enthusiasts, the distance a ball will travel when hit (hereinafter referred to as "distance") is an important design criterion. Since the U.S.G.A. rules were established, golf ball manufacturers have designed top-grade U.S.G.A. regulation balls to be as close to the maximum weight, minimum diameter, and maximum initial velocity as golf ball technology will permit. The distance a ball will travel when hit has, however, been improved by changes in raw materials and by alterations in dimple configuration.

Golf balls not conforming to U.S.G.A. specifications in various respects have been made in the United States. Prior to the effective date of the U.S.G.A. rules, balls of various weights, diameters, and resiliencies were common. So-called "rabbit balls," which claim to exceed the U.S.G.A. initial velocity limitations, have also been offered for sale. Recently, oversized, overweight golf balls have been on sale for use as golf teaching aids (see U.S. Pat. No. 4,201,384 to Barber).

Oversized golf balls are also disclosed in New Zealand Patent 192,618 dated Jan. 1, 1980, issued to a predecessor of the present assignee. This patent discloses an oversized golf ball having a diameter between 1.700 and 1.730 inches and an oversized core of resilient material so as to increase the coefficient of restitution. Additionally, the patent discloses that the ball should include a cover having a thickness less than the cover thickness of conventional balls. The patent has no disclosure as to dimple size or the percentage of surface coverage by the dimples.

Golf balls made by Spalding in 1915 were of a diameter ranging from 1.630 inches to 1.710 inches. While these balls had small shallow dimples, they covered less than 50% of the surface of the ball. Additionally, as the diameter of the ball increased, the weight of the ball also increased.

Golf balls known as the LYNX JUMBO were also produced and sold in October of 1979. This ball had a diameter of substantially 1.80 inches. The dimples on the LYNX JUMBO balls had 336 Atti-type dimples with each dimple having a diameter of 0.147 inch and a depth of 0.0148 inch. With this dimple arrangement, 56.02% of the surface area of the ball was covered by the dimples. This ball met with little or no commercial success.

Top-grade golf balls sold in the United States may be classified as one of two types: two-piece or three-piece. The two-piece ball, exemplified by the balls sold by Spalding Corporation under the trademark TOP-FLITE, consists of a solid polymeric core and a separately formed cover. The so-called three-piece balls, exemplified by the balls sold under the trademark TITLEIST by the Acushnet Company, consist of a liquid (e.g., TITLEIST TOUR 384) or solid (e.g., TITLEIST DT) center, elastomeric thread windings about the center, and a cover. Although the nature of the cover can, in certain instances, make a significant contribution to the overall coefficient of restitution and initial velocity of a ball (see, for example, U.S. Pat. No. 3,819,768 to Molitor), the initial velocity of two-piece and three-piece balls is determined mainly by the coefficient of restitution of the core. The coefficient of restitution of the core of wound balls can be controlled within limits by regulating the winding tension and the thread and center composition. With respect to two-piece balls, the coefficient of restitution of the core is a function of the properties of the elastomer composition from which it is made. Solid cores today are typically molded using polybutadiene elastomers mixed with acrylate or methacrylate metal salts. High-density fillers such as zinc oxide are included in the core material in order to achieve the maximum U.S.G.A. weight limit.

Improvements in cover and core material formulations and changes in dimple patterns have more or less continually improved golf ball distance for the last 20 years. Top-grade golf balls, however, must meet several other important design criteria. To successfully compete in today's golf ball market, a golf ball should be resistant to cutting and must be finished well; it should hold a line in putting and should have good click and feel. With a well-designed ball, experienced players can better execute shots involving draw, fade, or abrupt stops, as the situation dictates.

SUMMARY OF THE INVENTION

The golf ball of the present invention provides an improvement over previously proposed oversized golf balls. The present ball has an outside diameter of at least 1.70 inches and comprises a core, an inner cover, or mantle, and an outer cover. The mantle and the outer cover have a different Shore D hardness. Dimples cover at least seventy percent of the outer surface area of the ball.

DETAILED DESCRIPTION OF THE PREFERRED EMBODIMENT

The following description relates to several particular embodiments of the golf ball of the present invention, but the concept of the present invention is not to be limited to such embodiments. It should be noted that all of the specific dimensions set forth have a manufacturing tolerance of ±0.05%. Additionally, all of the balls have a weight no greater than 1.62 ounces.

Figure 1B:
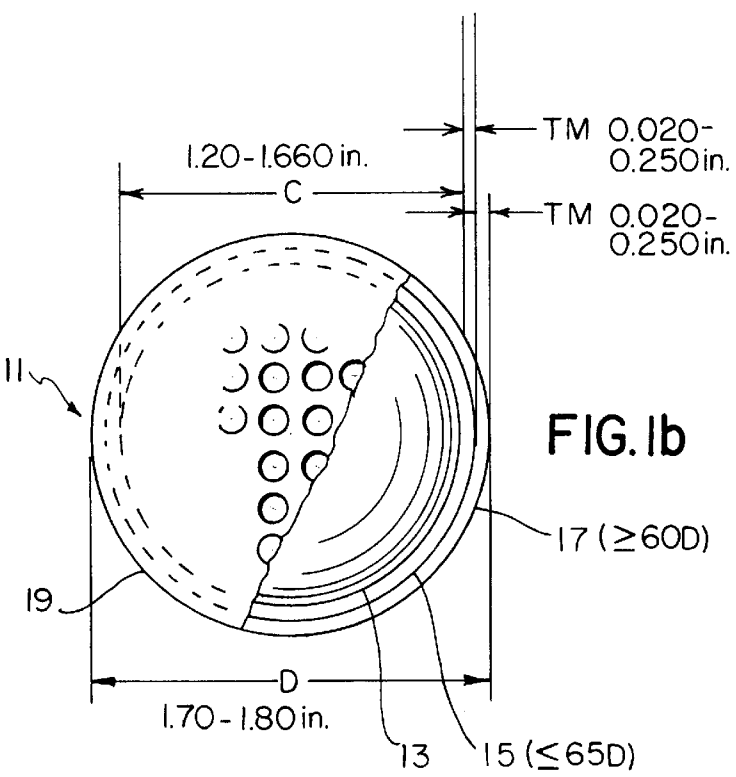
FIGS. 1A–B illustrates a partially broken-away view of an embodiment of the improved golf ball of the present invention.
Figure 1A:
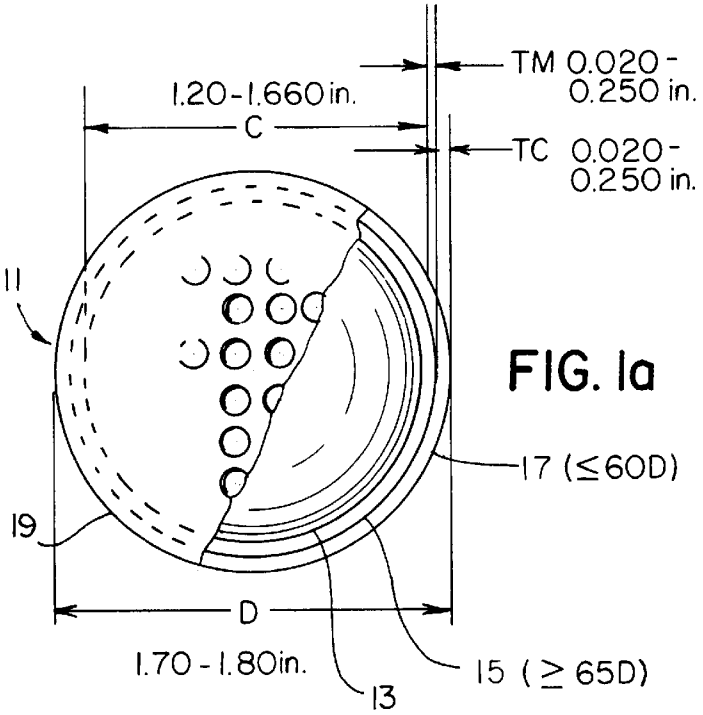

FIG. 1A–B shows the basic construction of the ball of the present invention. Ball 11 has a core 13. Outer cover 17 covers core 13 and mantle 15 and includes dimples 19 about its surface area.

The following description relates to the outer diameter D of the completed ball 11, the diameter C of core 13, the thickness TM of mantle 15 and the thickness TC of cover 17.

One embodiment of the present invention provides mantle 15 which entirely covers core 13. Mantle 15 is comprised of a hard ionomer or other hard polymer having a Shore D hardness of about 65 or more and outer cover 17 is comprised of a soft ionomer or other elastomer having a Shore D hardness of about 60 or less.

It has been found that multi-layer golf balls having inner and outer cover layers exhibit higher C.O.R. values and have greater travel distance in comparison with balls made from a single cover layer.

In addition, the softer outer layer adds to the desirable "feel" and high spin rate while maintaining respectable resiliency. The soft outer layer allows the cover to deform more during impact and increases the area of contact between the club face and the cover, thereby imparting more spin on the ball. As a result, the soft cover provides the ball with a balata-like feel and playability characteristics with improved distance and durability.

For a ball having a diameter of at least 1.70", the diameter of core C is preferably between 1.20 and 1.660 inches.

The thickness of mantle TM is preferably between 0.020 inches and 0.250 inches and the thickness of outer cover TC is preferably between 0.020 inches and 0.250 inches.

In another embodiment, mantle 15 is comprised of an ionomer layer which is softer then outer cover layer 17 and has a Shore D hardness of 65 or less, most preferably 10–60 and most preferably between 30–60. Outer cover layer is comprised of an ionomer having a Shore D hardness of about 60% or more, and preferably between 65 and 68, most preferably between 65–75.

The ball of this embodiment has a relatively low PGA compression of less than 90 and preferably 80 or less. This ball has good travel distance and low spin rate by virtue of the combination of a hard cover and a soft core and mantle.

In this embodiment, the diameter of core C is preferably between 1.20 inches and 1.60 inches, the thickness of mantle TM is preferably between 0.020 inches and 0.250 inches and the thickness of outer cover TC is preferably between 0.020 inches and 0.250 inches.

Figure 2:
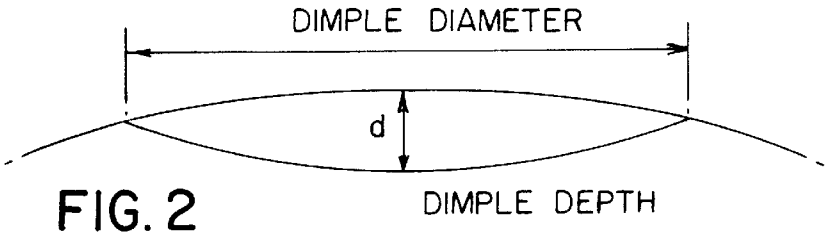
FIG. 2 illustrates dimple diameter and depth measurements.
Figure 3:
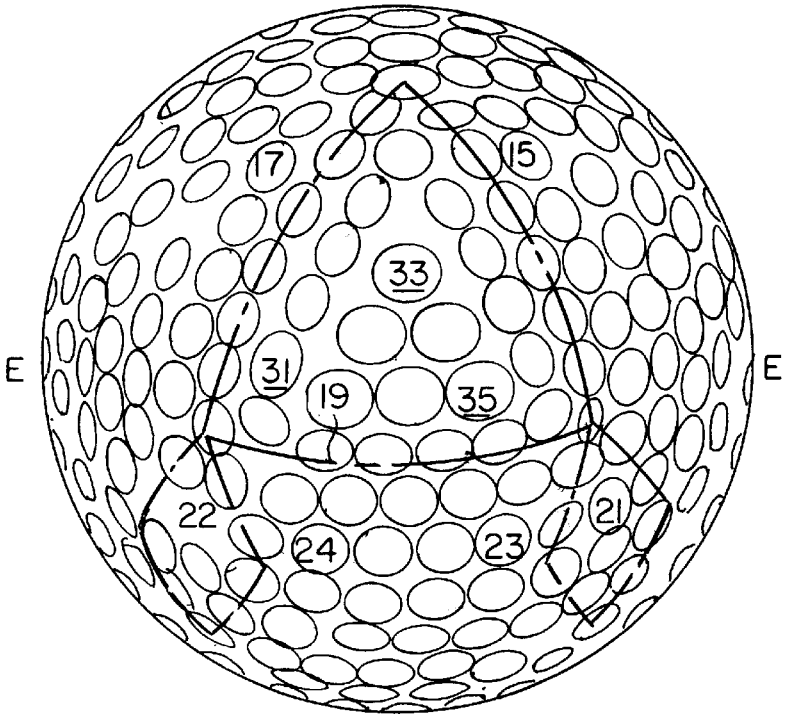
FIGS. 3, 4 and 5 disclose different dimple patterns which may be used with the present invention.

Referring to FIG. 3, there is shown a ball having the enlarged dimensions of the present invention and having a dimple pattern including 422 dimples, which includes dimples of three different diameters and depths measured in accordance with FIG. 2. As indicated in FIG. 3, the largest dimple 33 diameter is 0.169 inch with a dimple depth of 0.0123 inch, the intermediate dimple 35 diameter is 0.157 inch with a dimple dept of 0.0123 inch, and the smallest dimple 31 diameter is 0.145 inch with a dimple depth of 0.0101 inch. With the pattern shown, the resultant weighted average dimple diameter is 0.1478 inch and the weighted average dimple depth is 0.0104 inch. With this configuration and dimple size, 78.4% of the surface area of the ball is covered by dimples without any dimple overlap. The ball of FIG. 3 includes repeating patterns bounded by lines 15, 17 and 19 about each hemisphere, with the hemispheres being identical. One of such patters in shown in FIG. 4, which indicates the arrangement of dimples and the relative sizes of the dimples in that particular pattern.

Figure 4:
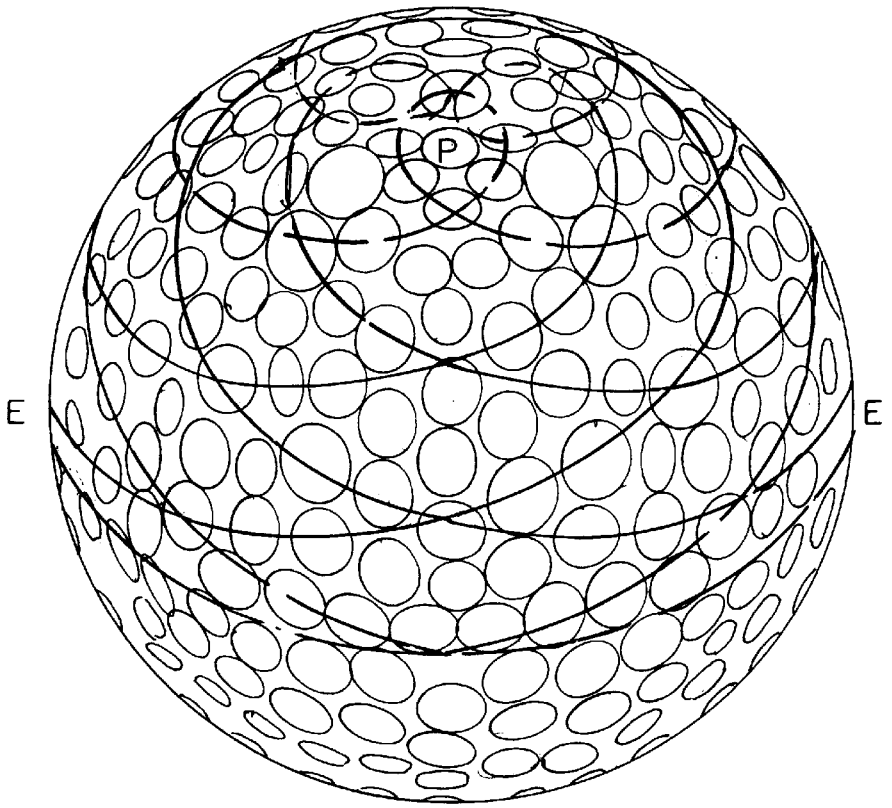

A further modification is shown in FIG. 4. This golf ball has 410 dimples comprising 138 dimples having a diameter of 0.169 inch and a depth of 0.0116 inch, 160 dimples having a diameter of 0.143 inch and a depth of 0.0101 inch, and 112 dimples having a diameter of 0.112 inch and a depth of 0.0077 inch. The configuration of the dimples comprises a dimple-free equatorial line E—E dividing the ball into two hemispheres having substantially identical dimple patterns. The dimple pattern of each hemisphere comprises a first plurality of dimples extending in four spaced clockwise arcs between the pole and the equator of each hemisphere, a second plurality of dimples extending in four spaced counterclockwise arcs between the pole and equator of each hemisphere, and a third plurality of dimples filling the surface area between the first and second plurality of dimples. In this ball, none of the dimples overlap. This pattern provides a weighted average dimple diameter of 0.1433 inch, a weighted average dimple depth of 0.010 inch, and a 73.1% coverage of the surface of the ball.

Figure 5:
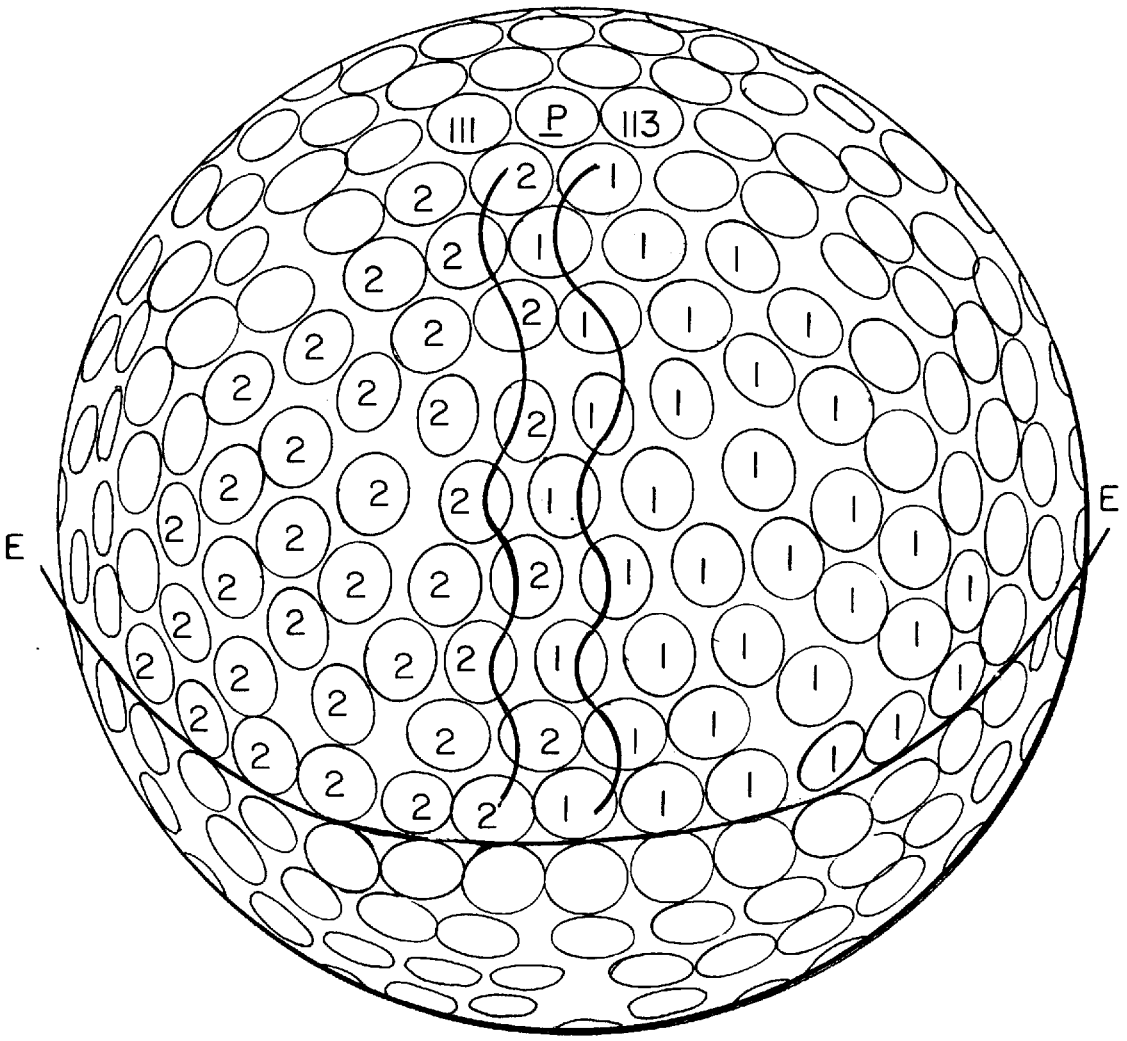

A still further modification is shown in FIG. 5. This golf ball has 422 dimples, all dimples having the same diameter of 0.143 inch and the same depth of 0.0103 inch. The dimples are arranged in a configuration so as to provide a dimple-free equatorial line, with each hemisphere of the ball having six identical dimpled substantially mating sections with a common dimple at each pole. FIG. 5 shows two mating sections having dimples 1 and 2, respectively. Each section comprises six dimples lying substantially along a line parallel with but spaced from the equatorial line, 29 dimples between the six dimples and the common polar dimple, with the outer dimples of each of said sections lying on modified sinusoidal lines 113 and 115.

Since only one diameter is used for all dimples, some small percentage of overlap occurs in order to provide substantial surface coverage with the dimples. For this particular pattern, there is an 11.4% (48) dimple overlap with a 73.2% coverage of the surface are of the ball. Overlap is determined by finding the number of dimples having an edge overlapping any other dimple and dividing that number by the total number of dimples on the ball, such number being expressed as a percentage.

In addition to the advantages discussed above, there is easier access to the ball with the club in both the fairway and rough because of the ball's size. This easier access allows for cleaner hits. Further, the increased size and moment results in the ball's ability to hold the line during putting. Thus, by increasing the percentage of dimple coverage of the surface of the ball, the ball has the advantages attributable to the larger ball while having enhanced flight characteristics as compared to previous balls having enlarged diameters.

The above description and drawings are illustrative only since obvious modifications could be made without departing from the invention the scope of which is to be limited only by the following claims.

We claim:

1. A golf ball of improved playing characteristics comprising:

a ball having an outside diameter of substantially 1.70 to 1.80 inches and a weight no greater than 1.62 ounces said ball comprising a spherical core;

a mantle surrounding said core;

an outer cover surrounding said core and said mantle;

said mantle and said outer cover having a different Shore D hardness; and said ball having a dimple pattern covering at least 70% of the surface of the ball.

2. The golf ball of claim 1 wherein the Shore D hardness of said mantle is greater than the Shore D hardness of said outer cover.

3. The golf ball of claim 2 wherein the Shore D hardness of said mantle is about 60 or more and the Shore D hardness of said cover is about 60 or less.

4. The golf ball of claim 1 wherein the Shore D hardness of said mantle is less than the Shore D hardness of said outer cover.

5. The golf ball of claim 4 wherein the Shore D hardness of said mantle has a Shore D hardness of about 65 or less and said outer cover has a Shore D hardness of about 60 or more.

* * * * *